United States Patent [19]

Laapotti

[11] Patent Number: 5,043,046

[45] Date of Patent: Aug. 27, 1991

[54] EXTENDED NIP-PRESS

[75] Inventor: Jorma Laapotti, Palokka, Finland

[73] Assignee: Valmet Paper Machinery Inc., Finland

[21] Appl. No.: 486,754

[22] Filed: Mar. 1, 1990

[30] Foreign Application Priority Data

Mar. 22, 1989 [FI] Finland ..... 891380

[51] Int. Cl.[5] ..... D21F 3/02

[52] U.S. Cl. ..... 162/358; 162/272; 162/359; 100/154

[58] Field of Search ..... 162/205, 272, 358, 360.1, 162/359, 361; 100/153, 154, 93 R

[56] References Cited

U.S. PATENT DOCUMENTS

| | | | |
|---|---|---|---|
| 3,748,225 | 7/1973 | Busker et al. | 162/358 |
| 3,783,097 | 1/1974 | Justus | 162/358 |
| 3,808,096 | 4/1974 | Busker et al. | 162/205 |
| 3,840,429 | 10/1974 | Busker et al. | 162/358 |
| 4,506,456 | 3/1985 | Lehtinen | 162/358 |
| 4,518,460 | 5/1985 | Hauser et al. | 162/205 |
| 4,563,245 | 1/1986 | Wanke et al. | 162/358 |
| 4,673,461 | 6/1987 | Roerig et al. | 162/358 |
| 4,874,469 | 10/1989 | Pulkowski et al. | 162/358 |

*Primary Examiner*—Karen M. Hastings
*Attorney, Agent, or Firm*—Steinberg & Raskin

[57] ABSTRACT

An extended-nip press for dewatering of a paper or board web, comprising a counter-member (10), which forms an extended press zone (S) together with a press-glide shoe (33) and a glide belt (40) running around the shoe. Through said zone (S), at least one dewatering fabric (50) and the web (W) from which water is removed and which is supported by said fabric are passed. The glide belt (40) is passed over a leading and tensioning member (43; 70), and the closed loop of the glide belt (40) is guided around its leading and tensioning member (43; 70) so that, between said leading and tensioning member (43; 70) and the glide shoe (33) and its possible guide parts (33*a*, 33*b*), if any, the glide belt (40) has, as a rule, substantially straight runs (40*a*, 40*b*). The space enclosed by the glide belt (40) and susceptible to oil splashes is closed at both of the end areas of the loop of the glide belt (40) by means of wall constructions (42*a*, 42*b*), which may, if necessary, be provided with expansion joints (61) fitted in such a way that movements of the glide shoe (33) and of the leading and tensioning member (43; 70) for the glide belt (40) in relation to one another are possible.

17 Claims, 4 Drawing Sheets

EXTENDED NIP-PRESS

BACKGROUND OF THE INVENTION

The invention concerns an extended-nip press for dewatering of a paper board or board web, comprising a counter-member, most appropriately a press roll, which forms an extended press zone together with a press-glide shoe and a glide belt running around the shoe, through which said zone at least one dewatering fabric and the web from which water is removed and which is supported by said fabric and passed, and which glide belt is passed over a leading and tensioning member.

In the prior art, extended-nip presses are known wherein the press zone is formed between a revolving belt mantle provided with a stationary core and a counter-roll. As is well known, in the stationary roll core hydraulically or hydrodynamically loaded pressure shoes are used, by whose means, by the intermediate of the revolving mantle, a compression pressure is applied to the web towards the counter-roll. The counter-roll may be either an ordinary smooth-faced or hollow-faced press roll, a variable-crown roll, or a belt mantle provided with a hydraulic glide shoe. As an example of the prior-art extended-nip press described above, reference is made to the GB Patent Application No. 2,057,027 as well as to the published Patent Applicant WO 82/02567.

In the patent applications mentioned above, no satisfactory solution has been suggested for the construction of the ends of the roll provided with a stationary core and with a revolving belt mantle. The object of said sealed ends is to prevent access of oil out of the interior of the roll mantle, e.g., to spoil the paper web. Lubrication fluid is needed in the lubrication between the inside face of the revolving mantle and the glide shoe or shoes that guide the mantle in considerable amounts. In this respect, reference is made to the U.S. Pat. No. 3,804,707, wherein an extended-nip press is described in which said roll ends are stationary and provided with resilient seal rings that rub against the inner face of the flange in the area of the ends of said roll mantle. Since the roll mantle has to alter its shape from the circular shape during each round of its rotation especially in the nip zone, this causes a considerable fatiguing and wearing load on said seal rings.

With respect to the prior art related to the present invention, reference is made further to the FI Patent Applications 821503 and 850213, to the FI Patent 66,932, to the DE Published Pat. Appl. 3,239,954, and to the U.S. Pat. No. 4,584,059.

One drawback, e.g., in the extended-nip presses known from the publications cited above is the lateral wandering of the belt mantle, because the prior-art devices have lacked efficient guide means for the belt mantle to keep the belt stably in its place laterally.

The press forces employed in extended-nip presses are of an order of $10^7$N, in which case a fully carrying lubricant film must be provided between the glide shoe and the belt mantle. In such a case, water is not adequate as a lubricant, but it is necessary to use different lubrication oils and hydrodynamic or hydrostatic lubrication chambers, the pressure level employed in said chambers being of an order of 4–8 MPa. The thickness of the belt mantles used is about 3–6 mm. This is why they can be guided exclusively by drawing, which also causes its problems in the guiding of the belts.

Long belt mantles are preferable to short circular hose mantles in the respect that their service life is considerably longer and the standstills resulting from replacement of belt mantle are less frequent. Thus, one object of the present invention is to make the intervals between said standstills longer.

An object of the present invention is to combine the good properties of a belt-mantle construction closed at its ends and of an open belt.

An object of the invention is to provide such an extended-nip press belonging to the species concerned wherein the opening gap of the nip can be made sufficiently large, as a rule about 30–50 mm, so that the glide belt and the press felts can be replaced as quickly as possible.

The main object of the present invention is to provide an extended-nip press belonging to the species defined at the beginning which is also suitable for thin paper qualities and for high machine speeds.

The employment of the prior-art extended-nip presses of the sort concerned at high running speeds and with thin qualities has been prevented completely or at least restricted, e.g., by the following circumstances. In a construction with an open long glide belt, oil leakages and oil mist are increased as the speed becomes higher. Instead, the glide belt has a relatively good service life (up to 6 months), because its bend-loading situation is favorable. Leakages of oil in a belt-mantle construction closed at the ends are small, even though this construction is not fully sealed either. Relatively short service life of the belt mantle can be a problem even at lower speeds, because the bend-loading situation of the belt mantle is difficult. The mantle has to bend to a "concave" shape in the area subjected to nip load as well as to a "convex" shape in the end area constructing an extension of the nip. Moreover, the circumferential dimension of the belt mantle is small and the frequency of load alternation becomes high.

SUMMARY OF THE INVENTION

The object of the present invention is to avoid the drawbacks that have previously been mentioned and to provide an extended-nip press construction wherein a closed construction is combined with a good loading situation of the press belt even when a relatively long glide belt is used.

In view of achieving the objectives stated above and those that will come out later, the invention is mainly characterized in that the closed loop of said glide belt is guided around its leading and tensioning member so that, between said leading and tensioning member and the glide shoe and its possible guide parts, if any, the glide belt has substantially straight runs most appropriately parallel to one another, and that the space enclosed by said glide belt and susceptible to oil splashes is closed at both of the end areas of the loops of the glide belt by means of wall constructions.

In the invention, in said wall constructions, there are preferably expansion joints arranged in such a way that movements of the glide shoe and the glide-belt leading tensioning member in relation to one another are possible. Said expansion joints are, however, not always necessary if the resilience of the sealing members is sufficiently high in view of opening of the nip and even in view of tensioning of the belt.

In the invention, the press shoe, which may be hydrodynamic or hydrostatic or a combination thereof, also forms the counter-face of one end area of the cycle of running of the glide belt, whereas the other end area consists of a roll or a corresponding glide-shoe arrangement, which, at the same time, acts as a tensioning member. The latter roll or equivalent is preferably grooved.

In the invention, in the running area of the glide belt in the press shoe, there may be low-pressure hydrostatic pressure chambers to ensure lubrication and to lower the friction force.

In the invention, the aligning of the glide belt takes place by means of an alignment roll against a belt-guide roll or by means of an alignment roll against a support plate placed inside the belt loop. The alignment roll may consist of narrow resilient-faced "wheels".

According to the invention, prevention of leakage of the lubrication oil placed inside the belt loop takes place, e.g., by means of hose-loaded lubricated seal ribs, which are placed preferably at both sides of the glide belt.

By means of the invention, the objectives as set above are achieved, and by its means a number of advantages important in practice are accomplished, which will be discussed below in more detail.

Since, in the invention, the diameter of the glide-belt guide roll or equivalent is equal to the belt-running width on the press shoe, tensioning and guiding of the belt do not cause problems of sealing at the ends. In the invention, a length-variation joint of the seal ribs and a length-variation joint of the end plates of the belt loop are used. These joints can be arranged favorably without problems.

The extended-nip press in accordance with the invention for this paper is preferably a single-felt press, whereby the opposite roll is a smooth roll that transfers the paper web, and the hollow face may consist most appropriately of grooves, blind-drilled bores, or the equivalent in the glide belt. Since the press for thin paper is most appropriately a single-felt press, the pressing result can be intensified by heating the press roll, e.g., by means of induction heating or IR-heating. The paper web and/or the press felt may also be heated by means known in prior art, such as by means of a steam box, an IR-heater, or a high-frequency heater.

The extended-nip press in accordance with the invention is also advantageous with thin paper qualities when the press level is sufficient, i.e. about 7 MPa, which can be achieved. Further advantages include more efficient dewatering, whereby the number of nips can be lowered, low level of oscillations, and possibilities of improving the properties of quality of the paper.

Even though, in the following, the invention will be described with reference to such an exemplifying embodiment only wherein the glide-belt/press-shoe device forms an extended nip with a counter-roll, it should be emphasized that the scope of the invention also includes extended-nip presses in which the counter-member consists of a member other than a press roll, e.g. a press-shoe device or a second glide-belt/press-shoe device or equivalent.

BRIEF DESCRIPTION OF THE DRAWINGS

In the following, the invention will be described in detail with reference to some exemplifying embodiments of the invention illustrated in the Figures in the accompanying drawings, the invention being by no means strictly confined to the details of said embodiments.

DESCRIPTION OF THE PREFERRED EMBODIMENTS

Figure 1:
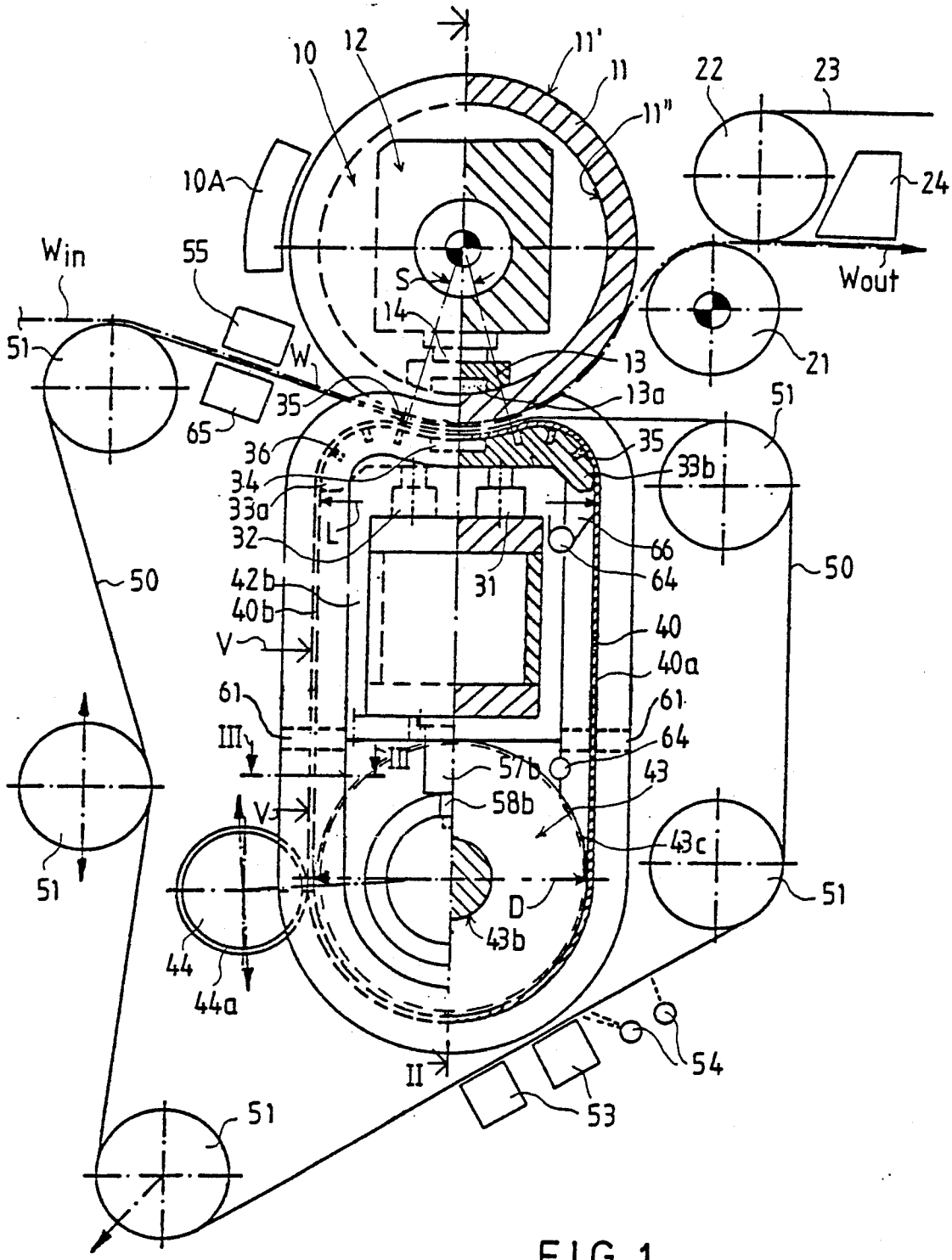
FIG. 1 is a side view of a first embodiment of the invention as a partial vertical sectional view in the machine direction.

The extended-nip press shown in FIG. 1 and having a wide press zone S comprises an upper counter-roll 10 which is provided with a mantle 11 revolving around a stationary central axle 12 on bearings 18*a* and 18*b*, said mantle 11 having a smooth outer face 11' and a smooth inner face 11''. The counter-roll 10 is a variable-crown roll provided with a journaling that withstands high loads and that consists of loading shoes 13 provided with loading members 14 and of liquid chambers 13*a*. A tubular roll journalled at its ends is also possibly embodied as a counter-roll 10. As is shown in FIG. 2, the counter-roll 10 is attached to its bearing supports 17*a* and 17*b* by its axle journals 15*a* and 15*b*, said bearing supports being provided with spherical bearings 16*a* and 16*b*.

Figure 2:
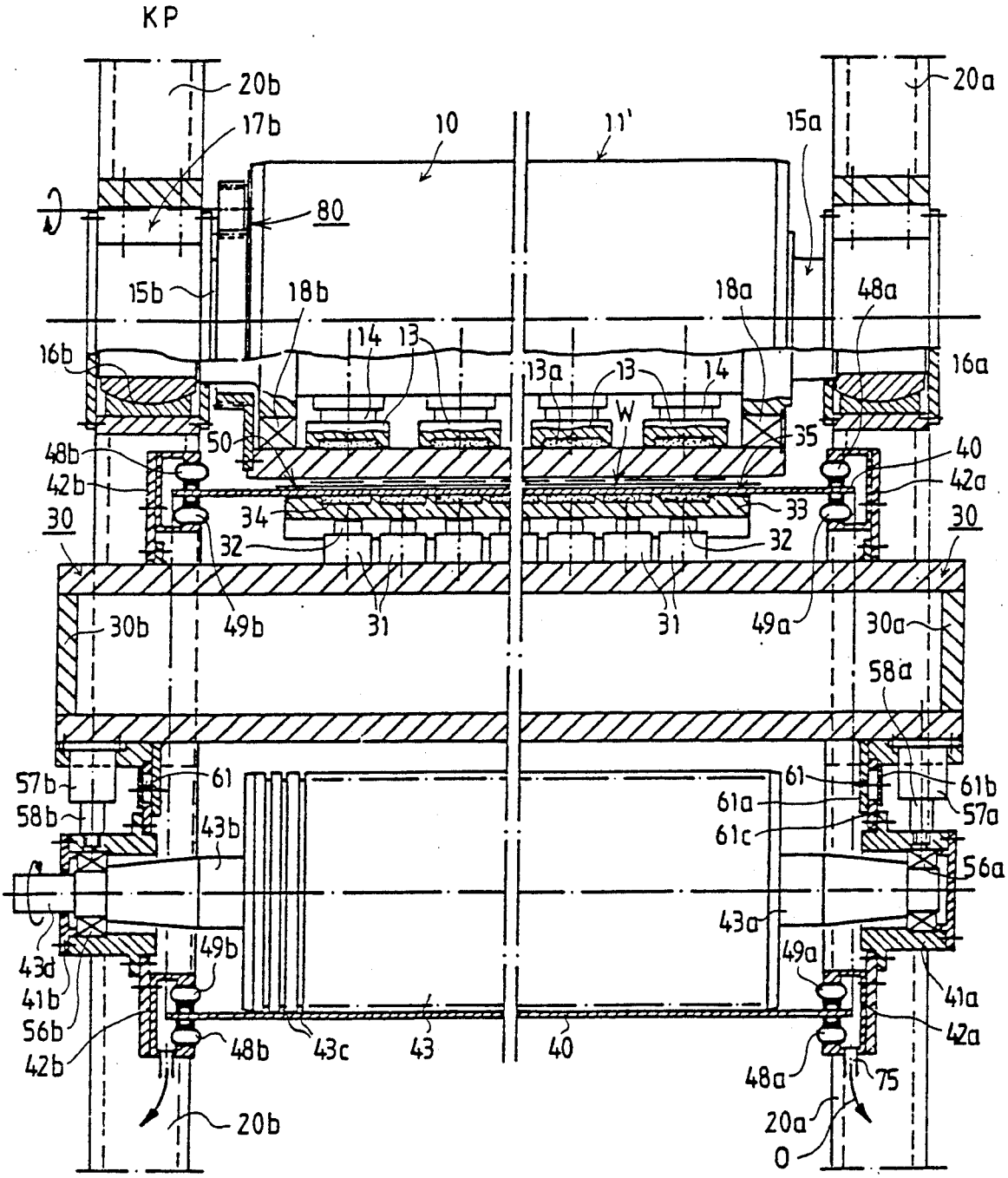
FIG. 2 shows a transverse vertical section II—II in FIG. 1.

FIGS. 1 and 2 show an extended-nip construction provided with one press felt 50, wherein the counter-roll 10 is a smooth-faced 11' preferably metal-faced roll, which permits heating of the roll face, e.g., by means of induction heating devices 10A. It is also possible to use infra-heating devices or flame heaters. Heating that takes place from inside the roll 10 is also possible, when a variable-crown roll is used, e.g., by means of hot-oil heating and, when a tubular roll is used, by means of steam, induction heater, IR-heaters, or equivalent. Also, it is possible to employ simultaneous heating of the counter-roll 10 from inside and from outside as well as various combinations of the different modes of heating described above.

As is shown in FIGS. 1 and 2, as an essential component the extended-nip press comprises a glide belt 40, which forms a closed belt mantle and which is preferably provided with an outside hollow face 40*a* in the construction which is shown in FIGS. 1 and 2 and which uses one press felt 50. As is seen best from FIG. 3, the hollow face 40*a* of the belt 40 is placed at the side of the press felt 50. The hollow face 40*a* in the belt 40 has been produced by means of grooves, blinding-drilled bores, by means of a coarse wire-like fabric placed on the outer face of the belt 40, or as a combination thereof. The outer face of the belt 40 may also be smooth, but that requires intensified dewatering of the press felt 50, e.g. an increased number of felt absorbers 53. Before the felt absorbers 53, there are water spraying devices 54. The loop of the felt 50 is guided by guide rolls 51. The glide belt 40 is preferably a polyurethane belt provided with a polyamide frame fabric. Moreover, the belt 40 may be made of a number of different composite materials.

Inside the loop of the belt 40, a transverse beam 30 is fitted, which is provided with closed ends 30*a* and 30*b*. Loading cylinders 31 are supported on the top side of the beam 30, and by means of the piston rods 32 of said loading cylinders forces are applied to the glide shoe 33 by whose means the compression pressure dewatering the web W is produced in the press zone S formed together with the counter-roll 10.

The glide belt 40 has a tensioning roll 43, which is supported on the bearing supports 41*a* and 41*b* by its axle journals 43*a* and 43*b* by means of bearings 56*a* and 56*b*. The bearing supports 41*a* and 41*b* are supported on the bottom side of the beam 30 by means of power units 57*a*, 58*a* and 57*b*, 58*b* so that, by means of said power units, the belt 40 can be tensioned while the sealing of both of its ends 42*a* and 42*b* remains tight. The belt 40 tensioning roll 43 is most appropriately provided with grooves 43*c*. The tensioning roll 43 may also be provided with an auxiliary drive, in which case it can be driven by means of the axle journal 43*d*. The bearing housings 41*a* and 41*b*, which move during the tensioning, are sealed against the end plates 42*a* and 42*b*. The beam 30 is passed through the end plate 42*a* and 42*b* at both of its ends and, to prevent leakages of lubricant, the beam is also sealed against the end plates 41*a* and 42*b*.

At both ends 42*a* and 42*b*, underneath the beam 30, there are length-variation joints 61, which permit movements of the tensioning roll 43 and the glide shoe in relation to one another, as well as an opening movement of the nip zone, which is about 30–50 mm. Said joints 61 are formed, for example, between wall portions 61*a* attached to the bottom side of the beam 31, the wall portion 61*b* placed at a distance from said wall portions 61*a*, and the edge portion 61*c* of the wall which can move as sealed between said wall portions. The latter portions 61*c* are attached in connection with the bearing supports 41*a*, 41*b* of the guide roll 43.

The side plates 42*a* and 42*b* are preferably attached by means of screws, so that, when the glide belt 40 is being replaced, the side plates 42*a* at the service side HP, and so also their seals 48*a*, 49, can be detached rapidly. The operation side of the frame is denoted with KP.

In FIG. 2 the leakage oil pipe 75 is shown, through which the lubricant can be passed in the direction of the arrow O out of the sealed box back to circulation. Moreover, FIG. 2 is a schematical illustration of the drive gearbox 80 of the counter-roll 10, of which said gearbox, e.g., the housing is not shown.

As is shown in FIGS. 1 and 2, the counter-roll 10 forms an extended press zone S together with the press shoe 33, which is hydrodynamic, hydrostatic, or a combination thereof. The press shoe 33 has a concave glide face 35 facing the counter-roll 10. The closed loop of the impervious press belt 40, which is guided over the glide face 35 of the press shoe 33, is passed over the tensioning roll 43. The diameter D of the guide roll 43 and the total width L of the glide face 35 and of the guide faces of the extension parts 33*a* and 33*b* placed at both sides of said glide face 35 are equally large as compared with one another (D=L). In view of the circulating running of the press belt 40 and in view of the sealing of the lubricant, it is preferable that, at both sides of the press zone of the press shoe, as fixed and continuous extensions of the glide face 35, there are convex guide parts 33*a* and 33*b* at both of its sides, said guide parts being preferably made of one piece with the press shoe 33. Said guide parts 33*a* and 33*b* and their glide faces are provided with glide portions consisting of hydrodynamic or hydrostatic lubricant chambers.

Within the scope of the invention, instead of a combination construction 33, 33*a*, 33*b*, a mobile press shoe and stationary belt-circulation glide shoes separate from it are also possible. In view of sealing of the lubricant, a press shoe 33 and belt 40 guide parts 33*a*, 33*b* integrated with each other are preferable.

In the invention, in addition to the length-variation and expansion joint 61 in both of the end walls 42*a*, 42*b*, another essential feature is that the overall width L of the glide shoe 33, 33*a*, 33*b* is equal to the diameter D of the leading and tensioning roll 43. In such a case, the glide belt 40 can be arranged sufficiently long and in such a way that it has runs 40*a* and 40*b* parallel to each other, which runs are easy to seal and owing to which the expansion joint 61 can be arranged easily.

As is shown in FIG. 1, substantially in the same plane with the tensioning roll 43, there is a belt 40 alignment roll 44, the direction of the axis of said alignment roll 44 being turnable in relation to the direction of the axis of the tensioning roll 43, whereby the belt 40 can be guided to run in the middle and its transverse wandering can be prevented. The alignment roll 44 is most appropriately a roll of one piece and of a length substantially equal to the length of the tensioning roll 43. The alignment roll 44 may also be composed of a few component rolls attached to the same axle. The alignment roll 44 is preferably coated with a resilient coating 44*a*, which is, e.g., made of rubber. The coating 44*a* may be provided with grooves, which increase the resilience of the face of the alignment roll 44, in order that the alignment roll 44 should contact the belt 40 better over its entire length even when the roll 44 has been turned slightly diagonally, by means of which turning an aligning effect is produced. FIG. 1 shows lubricant doctor devices 66, in whose connection there is a lubricant drain pipe 64.

Figure 3:
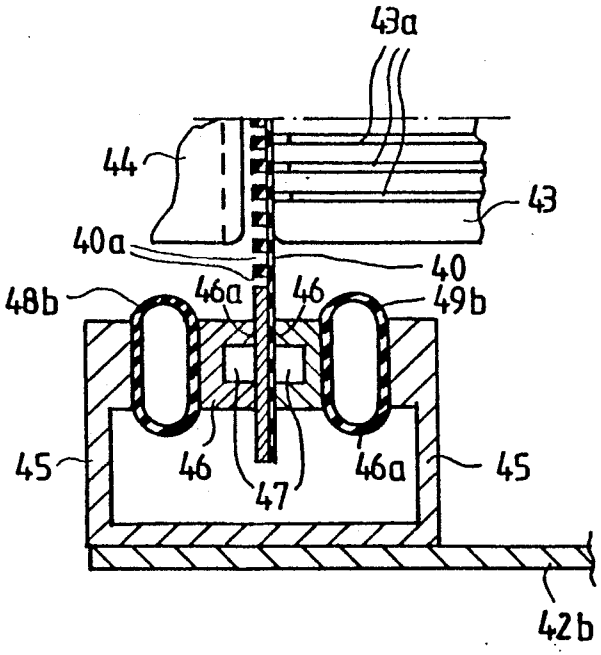
FIG. 3 shoes a section III—III in FIG. 1.

As is seen best from FIGS. 2 and 3, at both of the end plates 42*a* and 42*b* there are inside projection parts 45, between which there are loading members 48*a*, 49*a* and 48*b*, 49*b* for the resilient seals 46. According to FIG. 3, said loading members are hoses loaded by means of a pressure medium, but corresponding bellows constructions may also be used. In the resilient seals 46, there are lubricant grooves 47 inside. The seals 46 glide, one opposite the other, against the lateral areas of the belt 40 and seal any oil leakages. By altering the pressure passed into the loading members 48, 49, it is possible to adjust the sealing pressure against the inner face of the belt 40. The glide faces 46*a* of the seals 46 are, e.g., of plastic, whose wear can be reduced by means of lubricant fed into the lubricant grooves 47.

Figure 5:
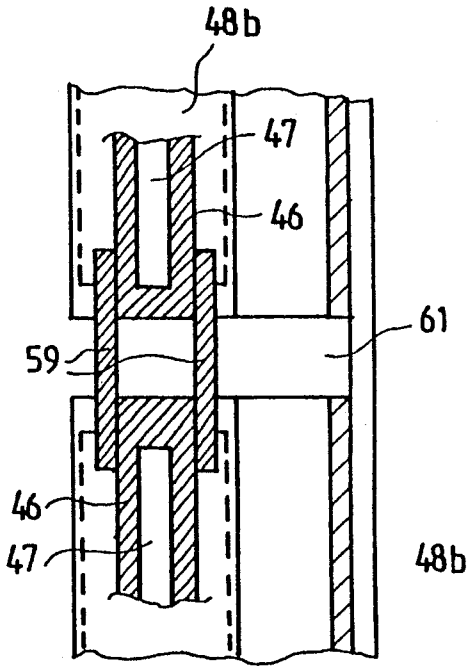
FIG. 5 shows a section V—V in FIG. 1.

From FIG. 5, which is a sectional view taken along the line V—V in FIG. 1, the joint of the seals 46 is seen, which joint permits movements of the glide shoe 33 and of the tensioning roll 43 relative one another in a plane parallel to the parallel (L=D) straight runs 40*a* and 40*b* of the glide belt 40. At both sides of the seals 47 there are glide pieces 59, which are placed facing the expansion joints 61 in the end plates 42*a* and 42*b*.

Figure 4:
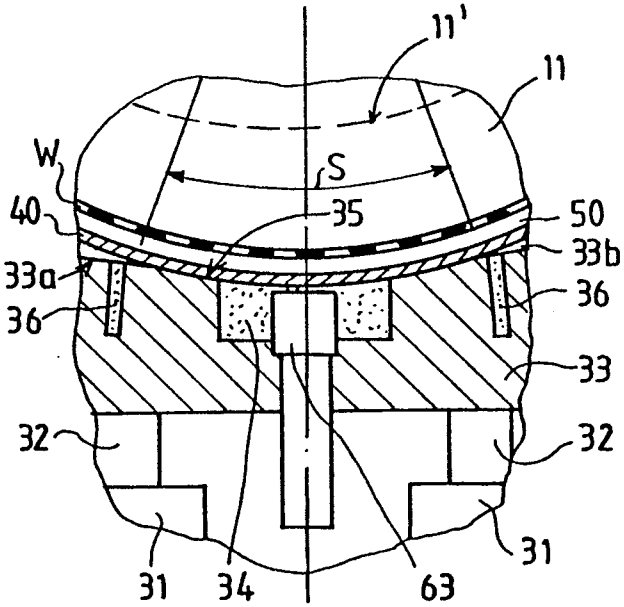
FIG. 4 is a vertical sectional view of the nip zone in the machine direction on an enlarged scale.

According to FIG. 1, heating devices 55 are placed at the inlet side of the paper web $W_{in}$ before the press zone S. By means of the devices 55, the heating can be carried out, e.g., as steam heating, IR-heating, or as high-frequency heating. A raised temperature in the paper web W intensifies the dewatering in the press zone S, where the dewatering can be intensified further, e.g., by means of ultrasonic oscillations. Thus, in FIG. 4, an ultrasonic oscillator 63 is shown, which is placed centrally in the pressure chamber 34 of the glide shoe 33. From the oscillator 63, the ultrasonic field is passed to proceed through the glide belt 40 and the press fabric 50 into the paper web W which is in the press zone S. thereby, the face 11' of the mantle 11 of the counter-roll 10 acts as a reflector for the ultrasonic oscillations and improves the efficiency of the ultrasonic treatment.

When a steam box is used as the heater 55, it is possible to use a suction device 65 inside the loop of the press fabric 50, opposite the steam box 55, which suction device intensifies the absorption of the steam into the paper web W.

After the press zone S, the web W departs from the press fabric 50 and follows the mantle face 11', whose surface is smoother than that of the press fabric, from which mantle face 11' the web W is detached and passed over the paper guide roll 21 and from which the web W is passed onto the drying wire 23, which runs over the drying-wire guide roll 22 and carries the web $W_{out}$ to the drying section (not shown). After the drying-wire guide roll 22 there is a suction device 24, which helps the paper web $W_{out}$ to adhere to the drying wire 23.

Figure 6:
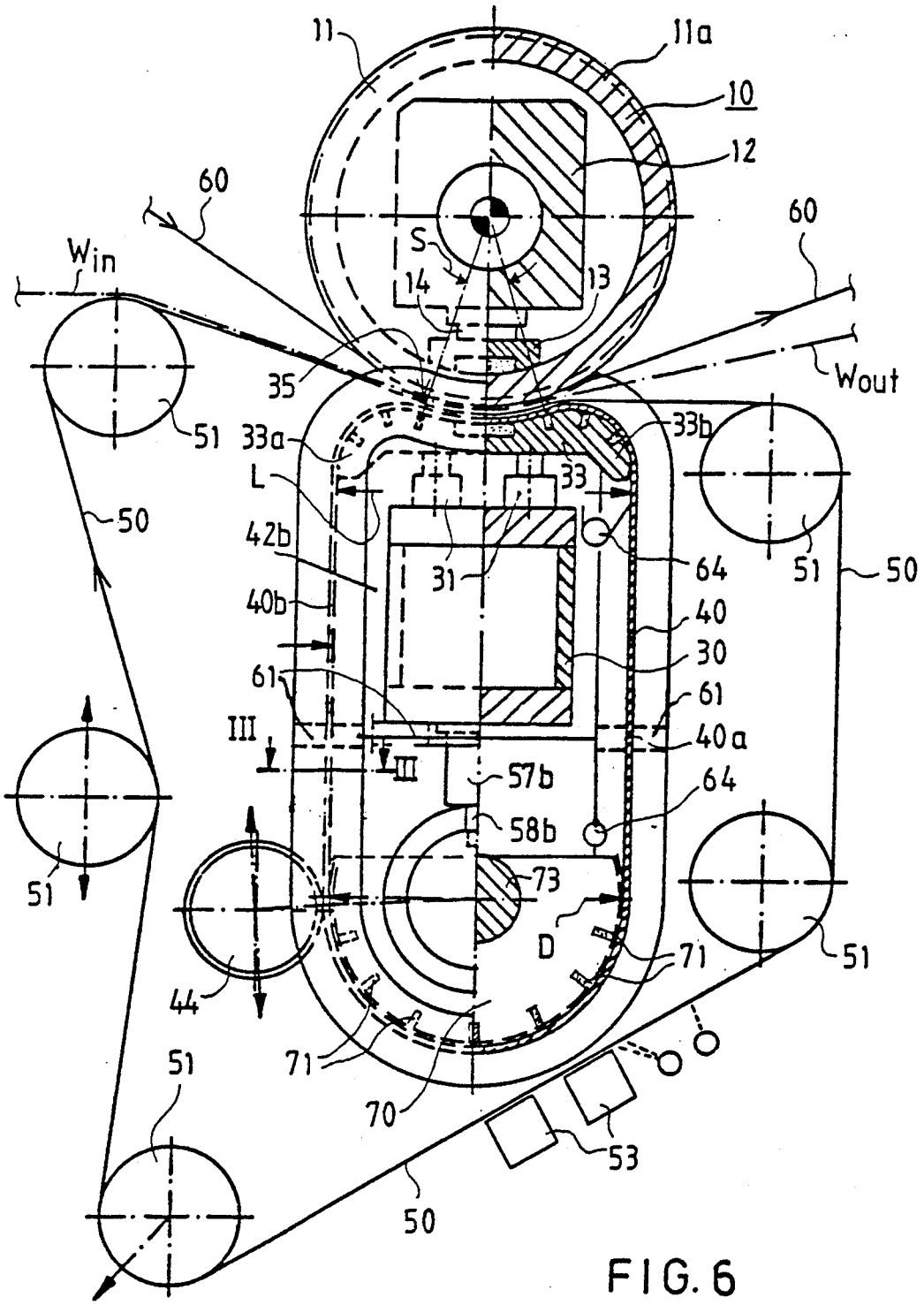
FIG. 6 shows a second, alternative embodiment of the invention in a way corresponding to FIG. 1.

FIG. 6 shows such a variation of the invention wherein two press fabrics 50 and 60 are used, between which the web W is passed through the press zone S. In such a case, the mantle of the counter-roll 10 is provided with an outside hollow face 11*a*, which is, e.g., a grooved or blind-drilled face.

In FIG. 6, after the press zone S, the web W is detached from both of the press fabrics 50 and 60 as soon as possible to avoid rewetting, being passed to the drying section (not shown).

A second difference in the construction shown in FIG. 6, compared with FIG. 1, is that the glide-belt tensioning roll 43 shown in FIG. 1 has been replaced by a convex tensioning glide shoe 70, which is provided with hydrodynamic glide faces or hydrostatic lubricant chambers 71. Since the glide shoe 70 is displaceable in connection with tensioning of the belt 40, the end portions extending beyond its ends 42*a* and 42*b* must be sealed relative to the end plates 42*a* and 42*b* so that movement is permitted.

In. FIG. 6, the diameter D of the glide shoe 70 is equal to the overall width L of the press-glide shoe 33, 33*a*, 33*b*, so that the glide belt 40 can be made sufficiently long and the bending radii of the glide belt 40 can be made sufficiently large in view of bending strains applied to the glide belt 40. Moreover, the glide belt 40 can be arranged so that it has opposite straight runs 40*a* and 40*b* parallel to one another between the glide shoe 33, 33*a*, 33*b* and the glide shoe 70. In such a case, the sealing between the glide belt 40 and the end walls 42*a*, 42*b* and the expansion joint 61 in the end walls can be arranged advantageously in the way described above, so that the box defined by the glide belt 40 and by the end walls 42*a*, 42*b* becomes sufficiently oil-tight in all situations of operation, and so that the glide belt 40 can be replaced quite rapidly.

When a glide belt 40 in accordance with the invention, similar to a crawler mat, is used, which has quite long opposite parallel straight runs 40*a* and 40*b*, the glide belt 40 can be made sufficiently long so that its resistance to wear and the intervals of its replacement become sufficiently large. The glide belt 40 is dimensioned, e.g., so that its length is within a range of 3 . . . 10 m, whereby the interval of its replacement becomes about 2 . . . 6 months.

Besides an alignment roll 44, an alternative mode in the guiding of the glide belt 40 consists thereof in that one edge of the belt 40 is tensioned more than the other edge by means of the tensioning roll 43 or a corresponding glide shoe 70. In other respects, the construction illustrated in FIG. 6 is similar to that described above in relation to FIGS. 1 to 5.

In the following, the patent claims will be given, whereby the various details of the invention may show variation within the scope of the inventive idea defined in said claims and differ from the details described above for the sake of example only.

What is claimed is:

1. An extended-nip press for dewatering of a paper or paperboard web, which comprises;

a counter-member;

a press-glide shoe;

a glide belt running around part of the periphery of said press-glide shoe such that an extended press zone is formed between said counter-member and said glide belt, said press zone being capable of having at least one dewatering fabric and said web passed therethrough to remove water from said web;

a leading and tensioning member having a diameter, said glide belt running around part of the periphery of said leading and tensioning member such that between said part of the periphery of said leading and tensioning member and said part of the periphery of said press-glide shoe said glide belt has two straight runs substantially parallel to each other, the width of said press-glide shoe being substantially equal to the diameter of said leading and tensioning member, and a pair of walls having a space between them and respectively located within a closed loop formed by said glide belt and respectively functioning to protect the space between them from lubricating oil splashes.

2. The extended-nip press of claim 1, wherein each of said pair of walls comprise an expansion joint, each said expansion joint being situated within a respective one of said pair of walls such that movements of said press-glide shoe and said leading and tensioning member relative to each other are facilitated.

3. The extended-nip press of claim 1, further comprising a plurality of sealing members, each of said sealing members being attached to a respective one of said pair of walls either directly or through an intermediate member.

4. The extended-nip press of claim 3, further comprising two tabular and/or bellows-like loading members, said loading members being loaded by a pressure medium, said loading members each comprising a sealing rib whose glide face rubs against said glide belt.

5. The extended-nip press of claim 4, wherein said sealing ribs have lubricant grooves therein.

6. The extended-nip press of claim 1, further comprising a frame beam around which said glide belt runs, and further comprising a first plurality of hydraulic loading members for said press-glide shoe, several of said plurality of loading members being arranged to control a transverse profile of distribution of compression pressure and further comprising, on an opposite side of said frame beam, a second plurality of loading members for regulating the position of said glide belt so as to regulate its tension.

7. The extended-nip press of claim 1, wherein said press-glide shoe has a concave press-glide face, and wherein said glide belt has convex guide faces respectively abutting said concave press-glide face of said press-glide shoe such that said convex guide faces of said glide belt constitute direct extensions of said press-glide face, and wherein said convex guide faces are hydrodynamically and/or hydrostatically lubricated, and that the combined width of said concave press-glide face and said convex guide faces is equal to the diameter of said leading and tensioning member.

8. The extended-nip press of claim 7, wherein said leading and tensioning member is a tensioning roll.

9. The extended-nip press of claim 8, wherein said tensioning roll has a grooved face.

10. The extended-nip press of claim 1, wherein said leading and tensioning member is a hydrodynamically and/or hydrostatically lubricated glide shoe having a face of substantially crescent-shaped cross section.

11. The extended-nip press of claim 1, further comprising an outside alignment roll functioning to transversely align said glide-belt, said outside alignment roll being situated in the proximity of said leading and tensioning member.

12. The extended-nip press of claim 1, further comprising an outside alignment roll functioning to transversely align said glide belt, said outside alignment roll being provided with a resilient coating.

13. The extended-nip press of claim 1, further comprising a dewatering fabric which contacts said glide belt.

14. The extended-nip of claim 13, wherein said dewatering fabric comprises a press felt and said counter-member is a smooth-faced press roll.

15. The extended-nip press of claim 1, further comprising two press fabrics which contact said glide belt and a web which passes between said two press fabrics, and wherein said counter-member is a hollow-faced roll.

16. The extended-nip press of claim 1, wherein said counter member is a smooth faced roll, further comprising a press felt and a web which pass through said press zone and an induction and/or IR heater mounted within said press such that said web and said felt are heated.

17. The extended-nip press of claim 16, wherein said heating is performed by apparatus from the group consisting of a steam box, an IR-heater, and a high-frequency heater.

* * * * *